United States Patent [19]

Rhodes

[11] 4,005,284

[45] Jan. 25, 1977

[54] ANALOG SIGNAL TO DUTY CYCLE CONVERSION APPARATUS

[75] Inventor: Melvin H. Rhodes, Cedar Rapids, Iowa

[73] Assignee: Rockwell International Corporation, El Segundo, Calif.

[22] Filed: Sept. 22, 1975

[21] Appl. No.: 615,758

[52] U.S. Cl. ..... 235/194; 307/271; 328/185; 340/347 AD

[51] Int. Cl.[2] ..... G06G 7/16

[58] Field of Search ..... 235/183, 193, 194, 196; 307/229, 235 N, 271; 328/144, 185; 340/347 AD

[56] References Cited

UNITED STATES PATENTS

| | | | |
|---|---|---|---|
| 3,482,116 | 12/1969 | James | 307/235 N X |
| 3,484,593 | 12/1969 | Schmoock et al. | 307/229 X |
| 3,517,339 | 6/1970 | Hubbard et al. | 307/271 X |
| 3,539,825 | 11/1970 | Hardaway | 328/185 X |
| 3,588,713 | 6/1971 | Yareck | 235/194 X |
| 3,714,470 | 1/1973 | Goldberg | 307/229 X |
| 3,749,942 | 7/1973 | Moses | 307/271 X |
| 3,778,794 | 12/1973 | Szabo et al. | 307/229 X |

OTHER PUBLICATIONS

D. F. Hoeschele, Jr., Analog-to-Digital/Digital-to-Analog Conversion Techniques, Wiley & Sons, Inc., 1968, pp. 356–357.

*Primary Examiner*—Jerry Smith
*Attorney, Agent, or Firm*—Bruce C. Lutz; Robert J. Crawford

[57] ABSTRACT

An analog signal to duty cycle converter and/or multiplier utilizing an integrator which integrates a composite of an input voltage and a feedback signal to produce a triangular waveform. The triangular waveform, depending upon the polarity of the input signal and the resultant voltage magnitude of the triangular waveform activates one of two sets of voltage sensitive switches for periodically applying feedback voltages to the integrator. If the feedback voltage sources are allowed to vary in amplitude, this variation affects the current or charge passed in the duty cycle obtained and effectively results in multiplication of the input signal times the feedback voltage source amplitude.

5 Claims, 8 Drawing Figures

ANALOG SIGNAL TO DUTY CYCLE CONVERSION APPARATUS

The Invention

The present invention is generally concerned with electronics and more specifically concerned with a device for changing an analog direct voltage signal into a pulsating duty cycle signal wherein the duty cycle is representative of the analog input.

While there have been analog voltage level signal to duty cycle converters in the past, it is believed that none have approached the simplicity of the present invention. An additional benefit of the present invention is that the output is representative not only of a signal used to drive the integrator directly, but it is also representative of the amplitude level of the signals used as the source for the feedback signals. Thus, the present invention may be used as merely a converter or may also be used as a multiplying device.

It is therefore an object of the present invention to provide an improved converting means.

Other objects and advantages of the present invention may be ascertained from a reading of the specification and appended claims in conjuction with the drawings wherein:

DETAILED DESCRIPTION

Figure 1:
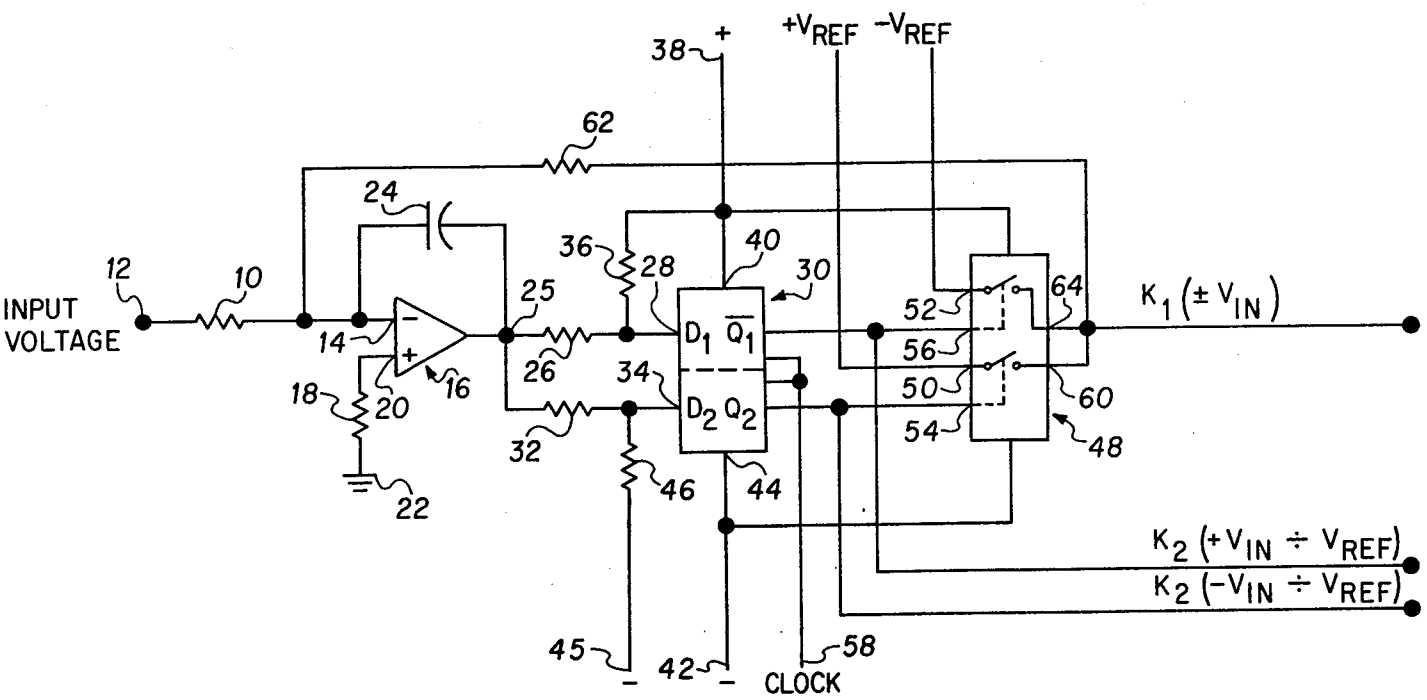
FIG. 1 is a block schematic diagram of an embodiment of the invention using D flip-flops as the voltage sensitive switching element.

In the converter multiplier apparatus of FIG. 1, a resistor 10 is connected between an input terminal 12 and a negative or inverting input 14 of a differential amplifier 16. A resistor 18 is connected between a non-inverting or positive input 20 of amplifier 16 and ground or reference potential 22. An integrating capacitor 24 is connected between an output 25 of amplifier 16 and input 14. A resistor 26 is connected between output 25 and a D1 input 28 of a dual D-type flip-flop block or voltage sensitive switch means generally designated as 30. This dual D-type flip-flop block may be of the type sold as part number CD4013 by RCA. This type of flip-flop contains two separate D flip-flops and although each contains both a Q and $\overline{Q}$ output, the requirements of this circuit utilize only the $\overline{Q}$ output for the upper flip-flop and the Q output for the lower flip-flop. A resistor 32 is connected between the output 25 of amplifier 16 and a D2 input 34 of block 30. A further resistor 36 is connected between input 28 of block 30 and a positive power potential generally designated as 38 which is also connected to a power input terminal 40 on dual D flip-flop 30. A negative power potential 42 is connected to a negative power input 44 of flip-flop 30. A further negative power source 45 is connected through a resistor 46 to the D2 input 34. In some embodiments power sources 42 and 45 may be the same as shown for source 38. Terminals 38 and 42 also supply positive and negative power respectively to an analog switch 48 which is shown schematically in internal connections as having first and second signal inputs 50 and 52 respectively connected to positive and negative reference voltage sources respectively. The switches or gates forming a part of these two input leads of block 48 are controlled by input terminals 54 and 56, respectively. Input 54 is connected to a $Q_2$ output of dual flip-flop 30 and is energized in accordance with D logic flip-flop when a logic 1 appears on input 34 and a rising clock pulse is simultaneously supplied from a clock input 58 to the flip-flop 30. Input 56 of block 48 is connected to the $\overline{Q}_1$ output of the upper D flip-flop of block 30 and becomes a logic 1 when a signal to input 28 is effectively a logic 0 and the clock on lead 58 is rising in potential. When a logic 1 is presented on lead 54, the input signal from lead 50 is connected to an output 60 and supplied through a resistor 62 to input 14 of amplifier 16. When a logic 1 appears at input 56, the switch connected to lead 52 is closed and an output appears at output 64 so as to supply the negative reference voltage through resistor 62 to the input of amplifier 16.

In FIGS. 2–5, a clock occurs at the indicated times for waveform A. A break between clocks 16 and 24 in FIG. 2 indicates an indeterminate elapsed time. Waveform B indicates the signal appearing at input 12 of FIG. 1. The waveform C is indicative of the signal being supplied from the output of block 48 to the resistor 62. Waveform D is indicative of that appearing at the output of integrator amplifier 16. Waveform E is indicative of the signal appearing at input 28 of the upper dual D flip-flop. Waveform F is indicative of the waveform appearing at input 34 of the lower D flip-flop. Waveform G is indicative of the signal appearing at the $\overline{Q}_1$ output of the upper flip-flop while waveform H is indicative of the signal appearing at the $Q_2$ output of the lower flip-flop.

Figure 2:
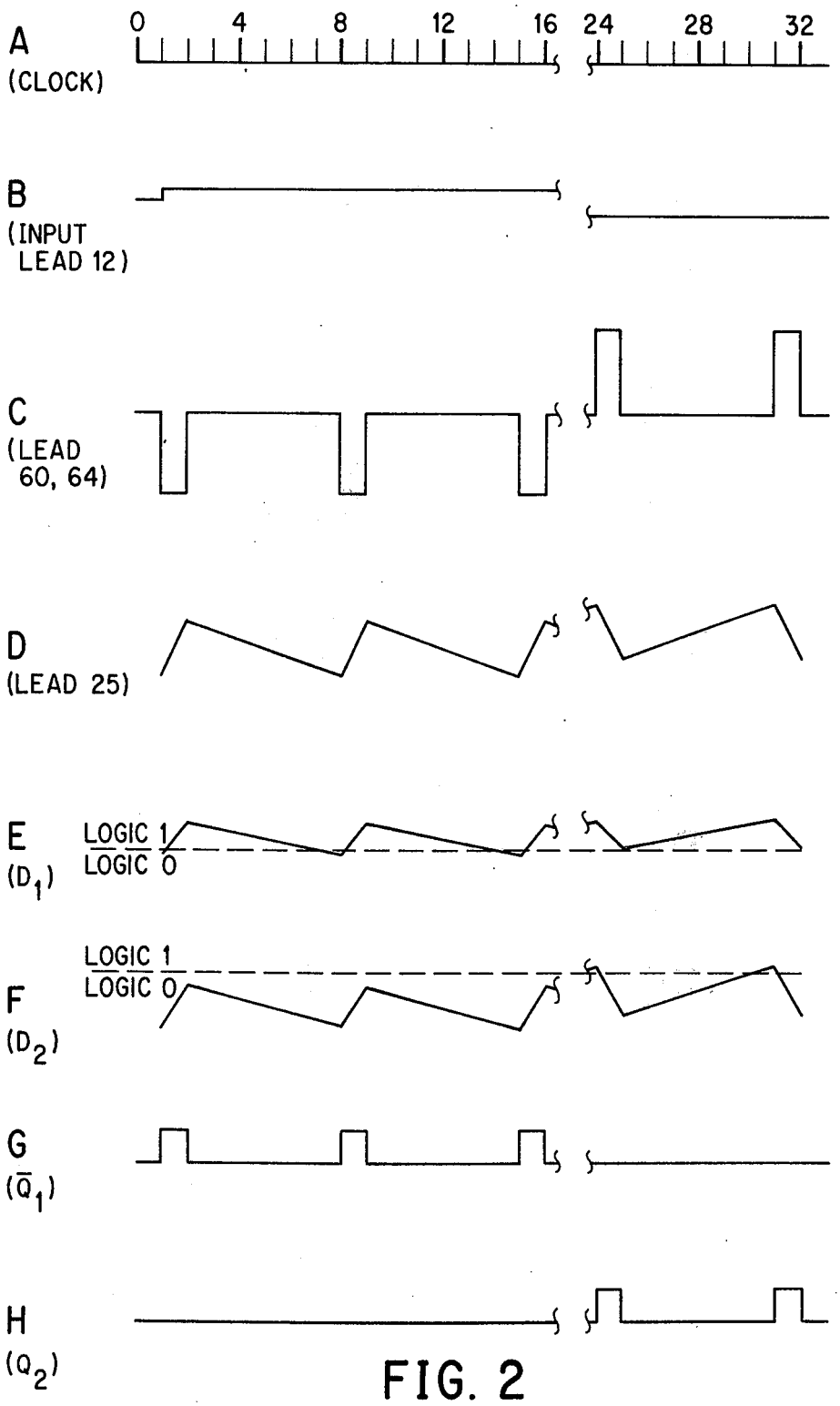
FIGS. 2, 3, 4 and 5 are waveforms used in describing the operation of FIG. 1.
Figure 3:
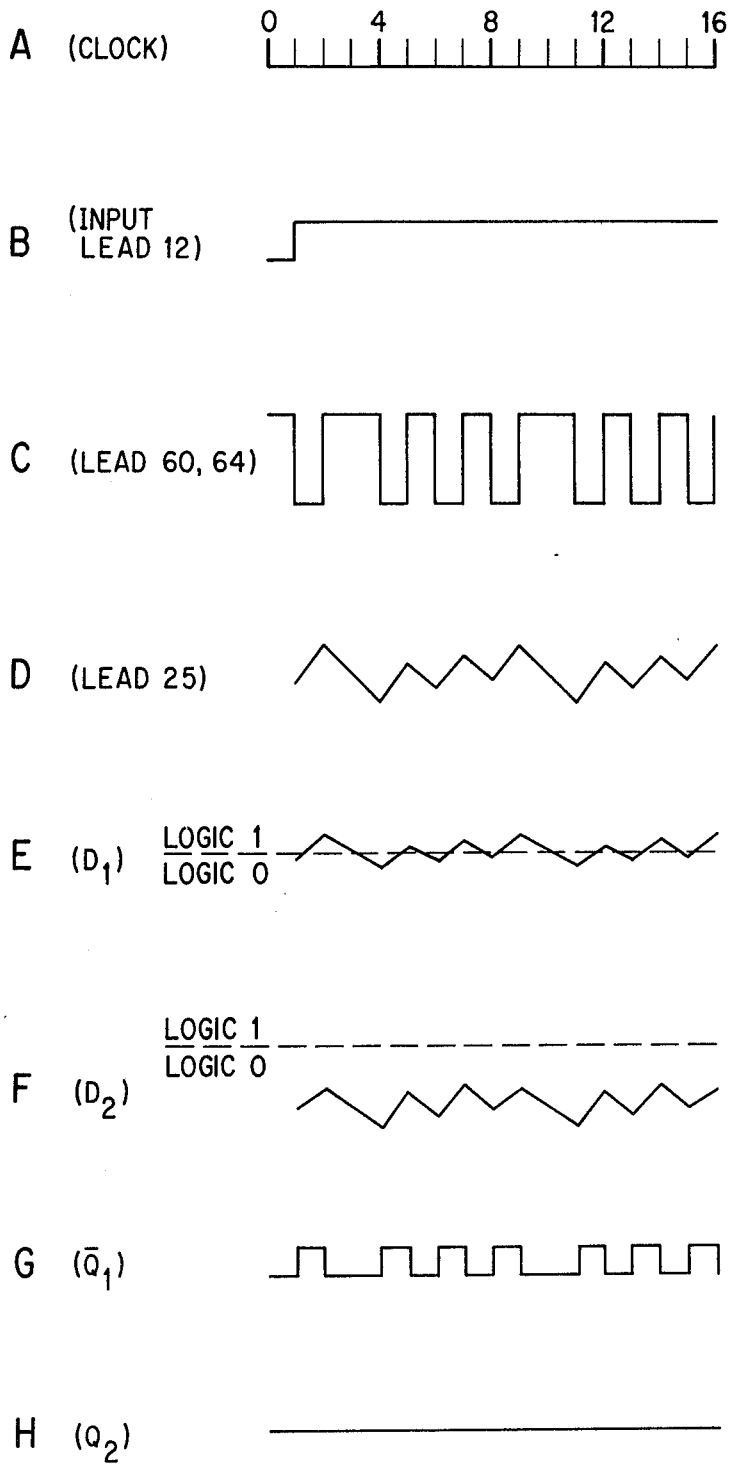

In FIGS. 2 and 3, the reference voltages being applied on leads 50 and 52 are kept at the same constant levels which for the purposes of illustration may be assumed to be 7 volts while the potential at input 12 is changed.

Figure 4:
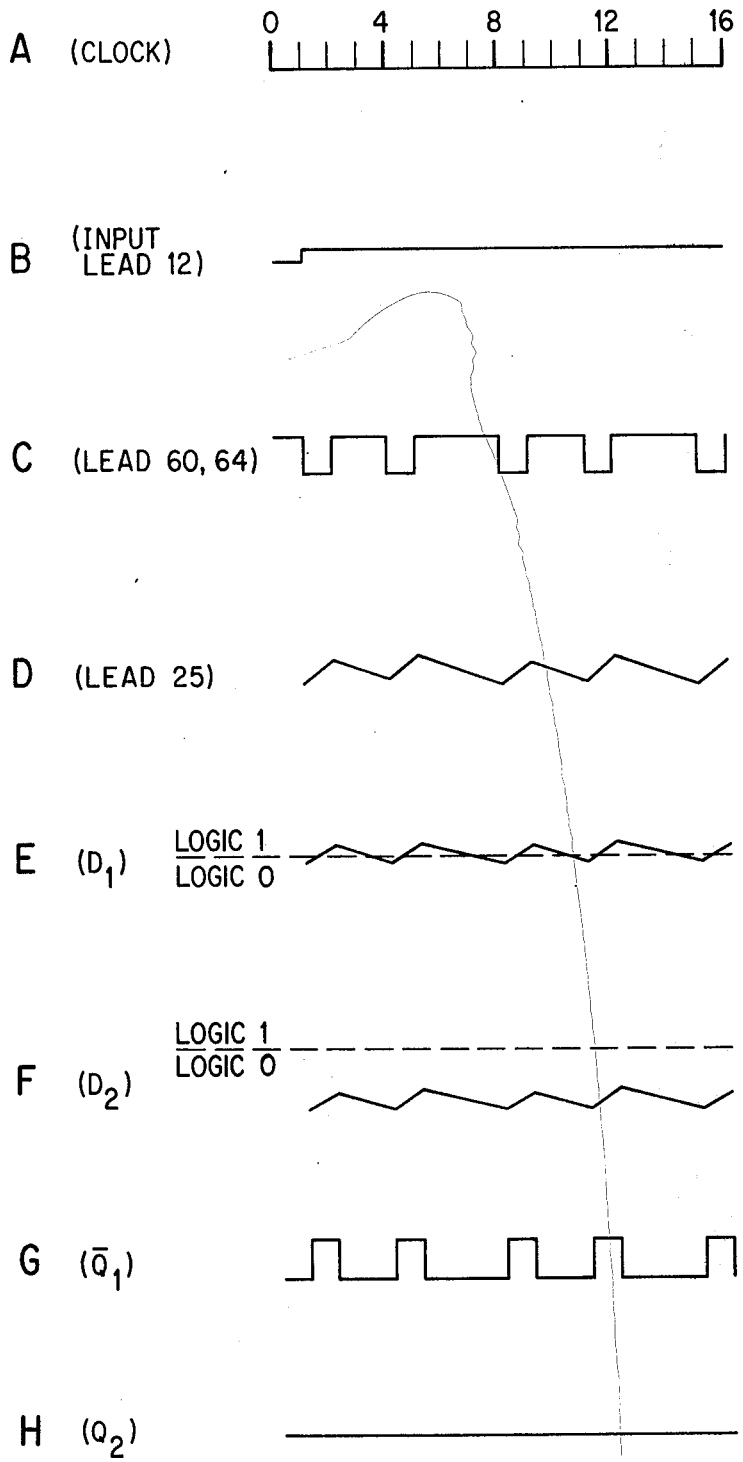
Figure 5:
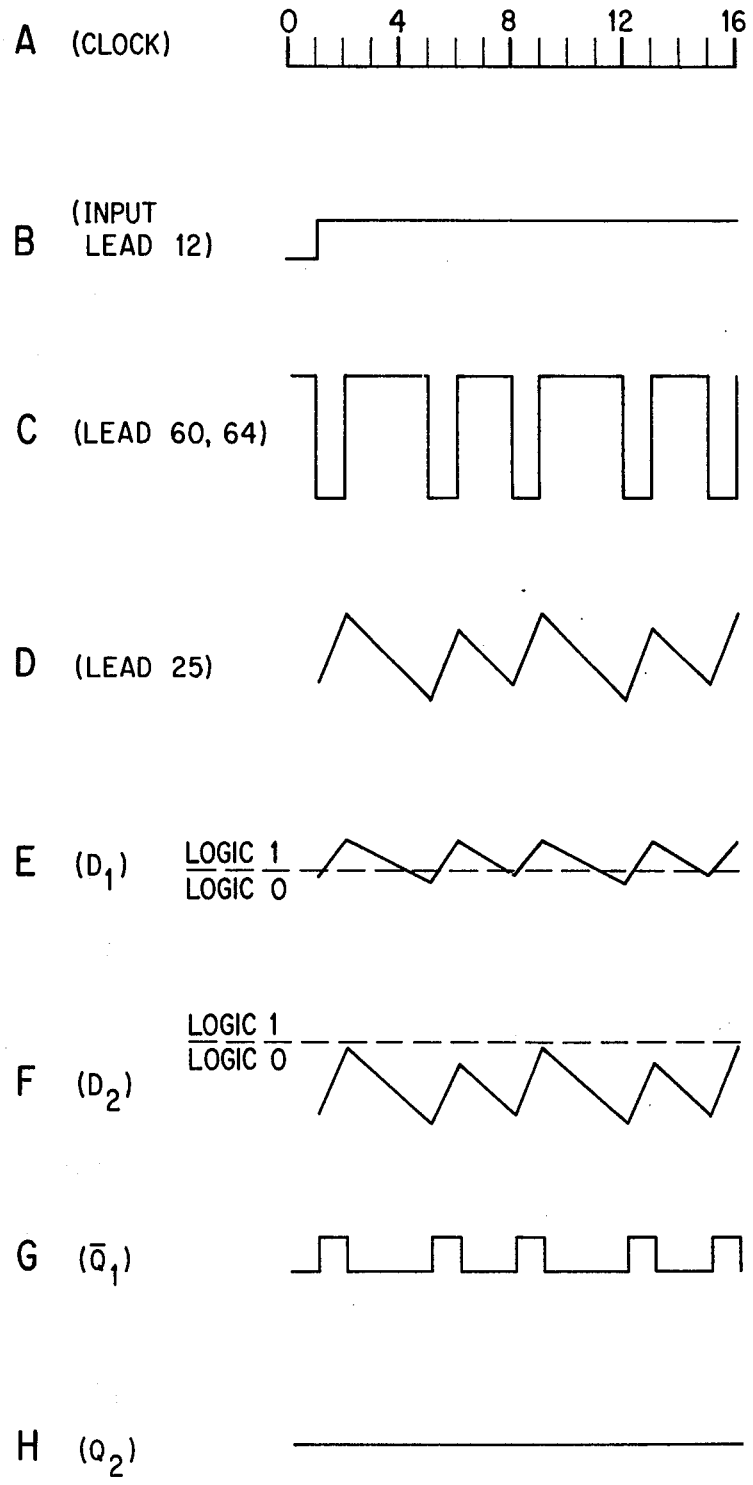

In FIGS. 4 and 5, the input potentials illustrated in FIGS. 2 and 3 are used while the reference potential voltages appearing on leads 50 and 52 are altered to illustrate the effect of changing the reference voltage upon the output signal.

The circuit of FIG. 1 is designed to alter an analog input voltage to a plurality of output pulses of positive and negative values which may be used in conjunction with further circuitry as illustrated in co-pending applications wherein, as an example, an output may be obtained indicative of rate of change of the input signal.

It may be noted that the analog switch 48 may be of the type sold by RCA under the Part Number CD4016 and designated as a COS/MOS Quad bilateral switch. Switch 48 would utilize two of the switch sections of such a switch. While RCA circuits have been designated as being usable in the circuits of this invention, it is obvious to those skilled in the art that other types of D flip-flops and analog switches may be used and that these ae exemplary only.

Operation

In operation, a positive polarity input signal is supplied to lead 12 and it passes through resistor 10 to start charging the integrating capacitor 24 feeding signals back from the output to the input of amplifier 16. As the capacitor commences charging, it will lower the potential of the output of integrator 16. From a starting condition, the D1 input will normally be a logic 0 and thus the $\overline{Q_1}$ output will activate the switch associated with the negative reference voltage. A negative reference voltage will be fed back through resistor 62 to the integrating amplifier 16. For purposes of explanation, it may be assumed that the reference voltage fed back is much larger than the input voltage. Thus, the negative voltage will override the effects of the signals appearing on lead 12 and will, after being inverted in amplifier 16, commence the output signal being driven in the positive direction so as to raise the potential on inputs D1 and D2. It will be noted that there is a bias so that at all times the input D1 is at a higher potential than input D2, since there is a voltage divider network comprising resistors 36, 26, 32 and 46 between the positive and negative potentials 38 and 45, respectively. Thus, as the output potential rises, input D1 will pass from the logic 0 condition to the logic 1 condition before input D2 passes from the logic 0 condition to the logic 1 condition. As will be noted, a logic 1 output is obtained from the $\overline{Q_1}$ output only when D1 is in a logic 0 condition and a logic 1 output is obtained from the $Q_2$ output only when D2 is in a logic 1 condition. Thus, at some point, flip-flop D1 will no longer maintain a logic 1 output to input 56 and at some later point in time as the output from integrator amplifier 16 is rising, the lower flip-flop is activated and there is a logic 1 appearing on input 54 so as to supply positive reference voltage to the output of switch 48 and accordingly the input of amplifier 16.

Using the above explanation as applied to FIG. 2, it will be noted that the waveforms of FIG. 2 start with the assumption that the output voltage from amplifier 16 has recently been low enough to activate the upper flip-flop thereby applying a negative feedback reference voltage to the input of amplifier 16. The output of amplifier 16 is driven high enough in one time period such that the upper flip-flop is returned to an inactive condition. Then, for the next 6 clock periods, no output is supplied from the flip-flop output and therefore no feedback voltage is available for summing with the positive input signal from 12 to amplifier 16. During the eighth time period, the upper flip-flop is again activated. From the ninth to the fifteenth clock time periods, the output from amplifier 16 is again such that neither flip-flop is activated. The circuit thus assumes a stable condition such that an output alternates and continually repeats until there is a change in reference voltage potential or on input voltage potential.

As illustrated, there is a break in FIG. 2 and it illustrates that the input signal of waveform B at time period 24 is as much negative with respect to ground as it was previously positive. Again, the circuit has stabilized. However, in this instance the lower flip-flop is periodically activated when the output of amplifier 16 becomes positive by too large an amount. This is illustrated at time period 24 and again at time period 31 wherein a positive feedback voltage is applied through resistor 62 via the activation of the gate switch connecting points 50 and 60 to rapidly drive the output potential of amplifier 16 in a negative direction for one time period.

In FIG. 3, the conditions were assumed that the potential appearing at input 12 is increased by an approximate factor of 3. The rest of the starting conditions as assumed in FIG. 2 were utilized and it will be noted that at time period 8 a stable condition is reached since it again assumes the same conditions as it did at time period 1 and the circuit remains in that configuration repeating the outputs until again either the input or the reference voltages change.

In FIG. 4, the reference voltages (V Ref) were assumed to be much smaller than previously assumed with the commencing conditions being otherwise the same. Thus, the lower flip-flop is not activated and the upper one is activated at a higher duty rate but the same total energy. As will be noted by the remaining waveforms in FIG. 4, the flip-flpp D1 is periodically activated as long as the input conditions are maintained.

In FIG. 5, the conditions of FIG. 3 were assumed except for a larger potential for the reference voltages. Although the pulse rate appears to go down, the energy supplied still remains the same.

If the input signal is altered to a negative voltage rather than a positive voltage, the waveforms G and H will be interchanged and thus the waveform C will effectively be inverted. In summary therefore, the circuitry of FIG. 1 produces an alternating potential output in response to an input signal and this alternating potential output is an inverted representation in the overall integrated value thereof of the signal supplied to input 12.

Figure 6:
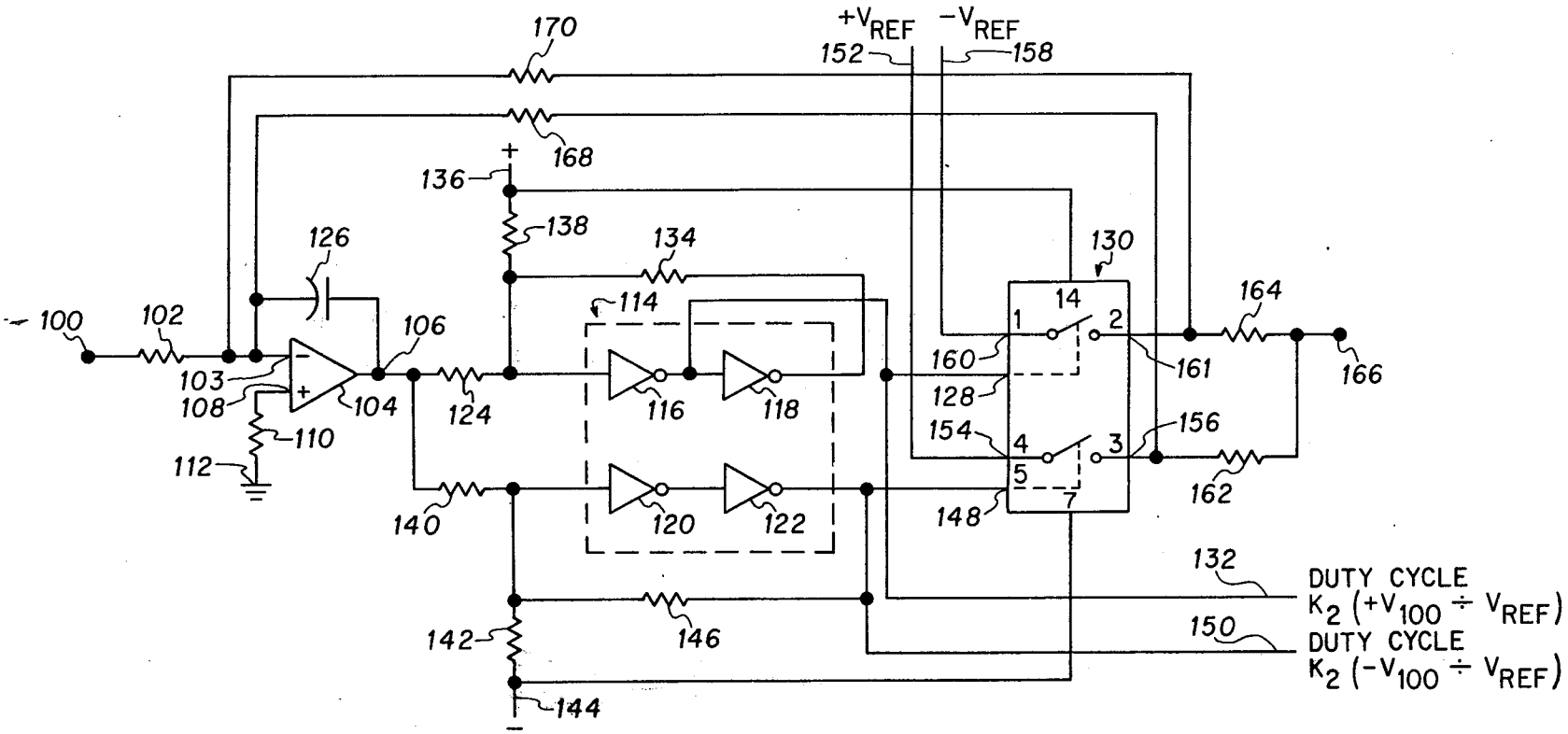
FIG. 6 is a schematic diagram of an embodiment of the invention utilizing converters as the voltage sensitive switching element.

The converter multiplier apparatus of FIG. 6 receives analog signal inputs at input 100 which signals are supplied through a resistor 102 to a negative or inverting input 103 of a differential amplifier generally designated as 104 and having an output 106 and a positive or non-inverting input 108. A resistor 110 is connected between input 108 and ground or reference potential 112. A dash line voltage sensitive switching block generally indicated as 114 contains a plurality of inverters 116, 118, 120 and 122 which are connected as shown. These inverters may be part of a package of devices such as sold by RCA under the designation CD4009A. A resistor 124 is connected between output 106 and an input of inverter 116. A capacitor 126 is connected between output 106 and input 103 of amplifier 104 to provide integrating capability thereto. An output of inverter 116 is connected to an input of inverter 118 as well as being connected to a control input 128 of a gate internal a switching block 130 and finally connected to an apparatus output 132 for providing a duty cycle output for positive polarity analog input signals. An output of inverter 118 is connected through a resistive means 134 to the input of inverter 116. A positive power potential 136 supplies current through a resistor 138 to the input of inverter 116. Further resistors 124, 140 and 142 complete a connection to negative power potential terminal 144. A junction between resistors 140 and 142 is connected to an input of inverter 120 and is also connected through a resistor 146 to an output of inverter 122. An output of inverter 120 is connected to an input of inverter 122. The output of inverter 122 is further connected to a control input 148 of a gate internal the switch 130 as well as being connected to an output terminal 150 supplying a duty cycle signal for negative polarity analog input signals. A positive reference voltage or further signal source 152 is connected to a first gate at an input 154 of switch 130. The switch associated with input 154 is controlled by control input 148 and determines whether or not the signals from 152 pass through switch 130 to an output 156. A further signal source or negative reference voltage 158 is connected to a second gate having an input 160 on switch 130. This gate is controlled by a input control signal at input 128. When a logic 1 is applied to input 128, the gate is closed and signals pass through switch 130 from terminal 158 to an output 161. Terminals 156 and 161 are connected respectively through resistors 162 and 164 to a common output terminal 166 and also through resistors 168 and 170 respectively to the input 103 of amplifier 104.

Figure 7:
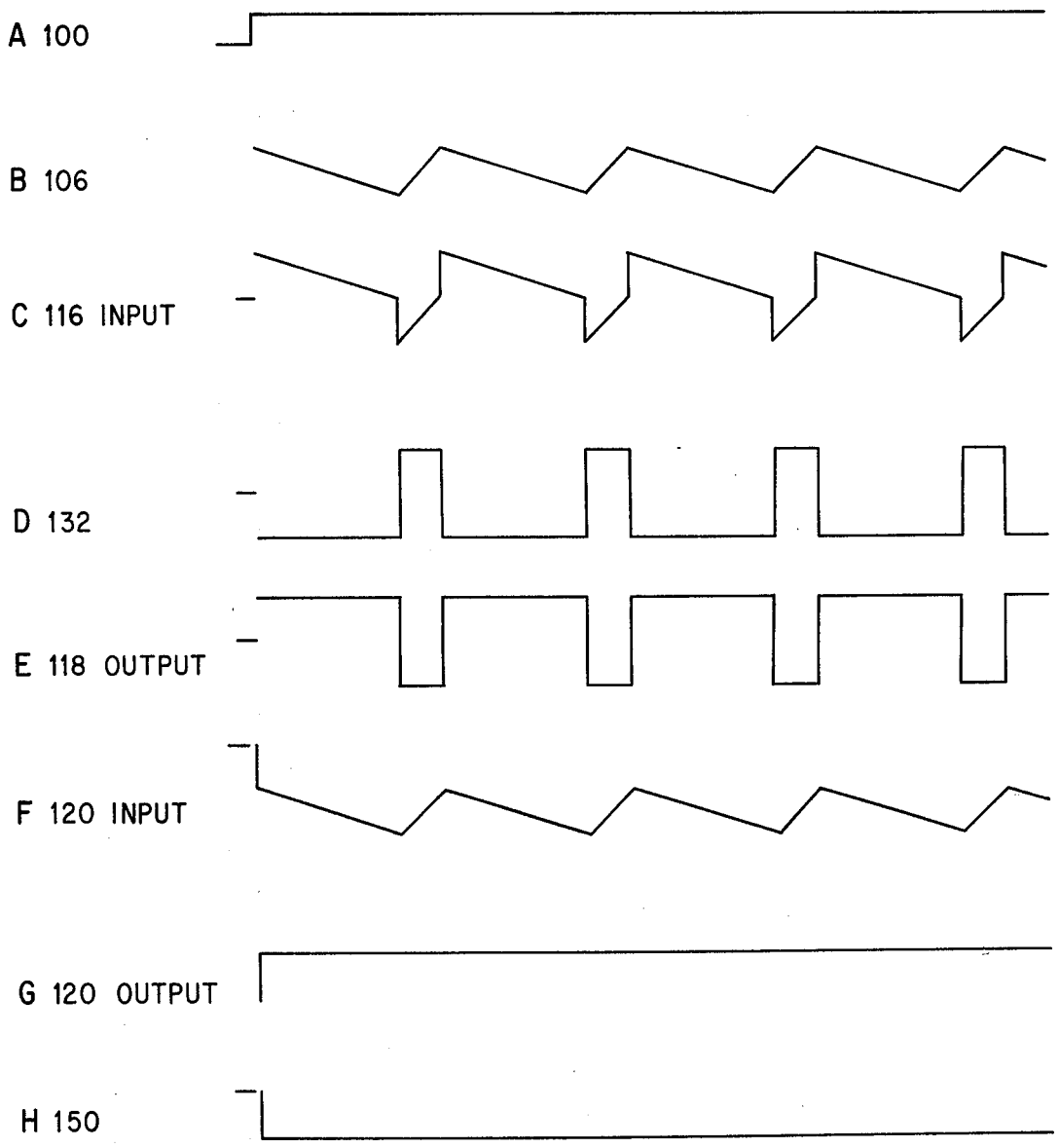
FIG. 7 and 8 comprise a series of waveforms used in describing the operation of FIG. 6.
Figure 8:
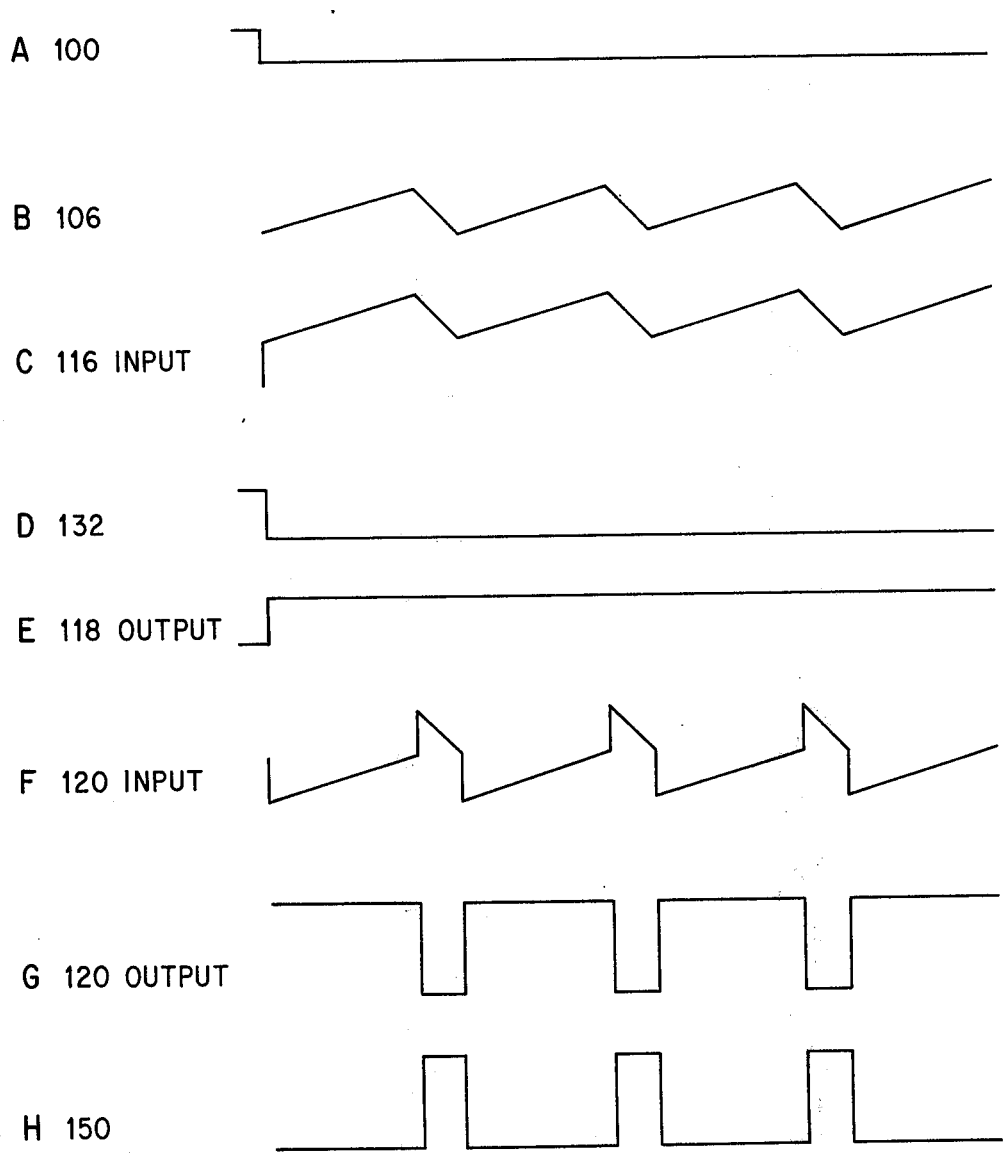

FIGS. 7 and 8 each contain waveforms A through H. Each of the waveforms is further designated by a number corresponding to a point in the circuit of FIG. 6. As will be noted, the waveforms of FIG. 7 illustrate the results of a positive signal input and the waveforms of FIG. 8 illustrate a negative input.

In operation, the converter of FIG. 6 is similar to that of FIG. 1. However, as previously indicated the voltage sensitive switch comprising the flip-flop of FIG. 1 does not switch until the input signal to the D input exceeds a predetermined amount and there is a simultaneous occurrence of a clock. The present design of FIG. 6 uses inverters rather than a flip-flop and thus does not need a clock to operate. It will be realized that the amplifier and the chain of inverters require positive and negative voltage power sources but these have not been shown to reduce the number of leads to be illustrated.

As illustrated in FIG. 7, it is assumed that a positive analog voltage is applied to terminal 100 which results in the integrator providing a slowly changing negative going signal at the output 106 of amplifier 104 as illustrated in waveform B of FIG. 7. The resistors 138, 124, 140 and 142 provide biasing networks to the inverters 116 and 120. When the output of integrator 104 is at ground potential, the input to inverter 116 is considerably higher than logic 0. As will be explained later, inverter 116 must have a logic 0 input in order to close the gate between 160 and 161. Also, when point 106 is at ground potential, the input to inverter 120 is at a logic 0 level considerably below its logic 1 level. As will be noted, a logic 1 input to inverter 120 provides a logic 1 output from 122 and thus actuates the gate between terminals 154 and 156 in switch 130.

As discussed above, the appearance of a positive signal at input 100 slowly decreases the amplitude of the signal on lead 106 until it is low enough to change inverter 116 due to passing of its threshold point to provide a logic 1 output and thereby actuate the appropriate gate via input 128 and thereby provide a negative signal source through the feedback resistor 162 to be summed with the analog input. The activation of inverter 116 produces a negative going output from inverter 118 and this inverted output is fed back through feedback resistor 134 to the input of inverter 116. This causes the input thereof to drop to a further negative value as shown in waveform C. This further negative drop then commences in a positive direction due to the multiplier feedback signals being supplied through resistor 170 to the input of amplifier-integrator 104. When the output of amplifier 104 is sufficiently positive, the inverter 116 will again switch to open the upper switch internal switching means 130. Simultaneously, the inverter 118 will switch and cause a feedback signal through resistor 134 in the positive direction to place the input of inverter 116 at an even higher potential as again illustrated in waveform C. This establishes a stable and repetitive series of events which continue until the amplitude of the input signal or the amplitude of the negative reference voltage appearing on lead 158 changes.

As will be noted, the output of amplifier 104 is far enough negative and stays in this condition with a positive input such that inverter 120 does not alter its state. Thus, as illustrated in waveforms G and H, this portion of voltage sensitive switch 114 remains inactive until a negative input is supplied as illustrated in FIG. 8. Substantially, the same reactions occur in FIG. 8 except that the lower switch of 130 is activated and positive multiplier potentials are fed back through resistor 168 to the input of integrator 104.

Since no clock is used in this embodiment, some type of hysteresis is necessary to obtain the pulse width variation. This is obtained by the feedback signals passed through resistors 134 and 146 to produce the strange-looking waveforms at the inputs of the respective inverters 116 and 120 as shown in FIGS. 7C and 8F.

Although two sources, 152 and 158, of multiplier signals are shown, it will be realized that a single source with an inverter could be used to supply the two inputs 154 and 160 of switch 130 to supply the proper polarity feedback signals.

From the previous discussion in connection with FIG. 1, it may be ascertained that changes in input signal amplitude will alter the duty cycle of waveform D for positive inputs. Variations in the amplitude of the signals at 152 and 158 will also vary the duty cycle but will not vary the total energy passed. Thus, the output at lead 166 is indicative of the product of the analog signal at 100 times a constant K. Thus, the signals at 132 and 161 are indicative in duty cycle of the amplitude of positive polarity signal inputs at input 100. The same general principle applies to the signals appearing at 150 and 156 for negative input signals applied to input 100. Thus, the present circuit, as was the case with FIG. 1, provides a common product or duty cycle signal for either polarity inputs at the output of switch 130 on terminal 166 or provides selective duty cycle or product outputs at 132 and 150, respectively.

While two embodiments of my inventive concept have been illustrated and described, it is to be realized that other variations will occur to those skilled in the art. Thus, I wish to be limited not to the embodiments shown and described, but only by the scope of the appended claims.

What is claimed is:

1. Analog to pulse density converting apparatus comprising, in combination:

first switch means including first and second gating means each having an input means, an output means and a control means for controlling a conductive path between said input means and said output means of the gating means;

first and second feedback signal source means connected to said input means of said first and second gating means respectively of said first switch means;

integrating means, including input means and output means;

analog signal supplying means;

means connecting said analog signal supplying means and said output means of said first switch means to said input means of said integrating means for supplying two signals thereto to be integrated;

voltage sensitive second switch means including input means and first and second output means, said second switch means providing a given polarity output at said first output means thereof when a signal at said input means thereof exceeds a first polarity reference level and the second output means thereof providing an output signal of said given polarity when a signal provided to said input means thereof exceeds a second polarity reference level;

means connecting said output means of said integrating means to said input means of said second switch means; and means connecting said first and second output means of said second switch means to said control means of said first and second gating means respectively of said first switch means, the output signal from said first output means of said voltage sensitive switch means being representative in pulse density of the amplitude of positive signals provided by said analog signal supplying means and the output signal at said second output means of said second switch means being representative in pulse density of the amplitude of negative signals supplied by said analog signal supplying means.

2. Apparatus as claimed in claim 1 wherein said second switch means comprise a pair of D-type flip-flops.

3. Apparatus as claimed in claim 1 wherein said second switch means comprises two pairs of feedback connected inverters.

4. Multiplying apparatus comprising, in combination:

first means for supplying a multiplicand signal;

second means for supplying feedback multiplier signals, said second means including first and second control means for supplying respectively positive or negative polarity multiplier signals in response to control signals applied thereto;

integrator means connected to said first and second means for receiving multiplier and multiplicand signals;

voltage sensitive switching means, including input means and first and second output means, said voltage sensitive switching means providing a control output signal at said first output means in response to a signal exceeding a given amplitude of a first polarity applied to said input means and providing a control output signal at said second output means in response to a signal exceeding a given amplitude of a second polarity applied to said input means;

means connecting said integrator means to said input means of said voltage sensitive means for supplying integrated signals thereto;

means connecting said first and second output means respectively to said first and second control means; and apparatus output means connected to said second means for supplying apparatus product output signals.

5. Analog to pulse repetition rate converting apparatus comprising, in combination:

first and second gating means each having input means, output means and control means for controlling a conductive path between said input means and said output means of said gating means;

first and second feedback signal source means connected to said input means of said first and second gating means respectively;

integrating means including input means and output means;

analog signal supplying means;

means connecting said analog signal supplying means and said output means of said first and second gating means respectively to said input means of said integrating means;

voltage sensitive switch means including input means and control signal output means, said voltage sensitive switch means providing output control signals when a signal at said input means thereof exceeds a given amplitude;

means connecting said output means of said integrating means to said input means of said switch means; and means connecting said output means of said switch means to said control means of said gating means, the output signal from said output means of said voltage sensitive switch means being representative in pulse repetition rate of the amplitude of signals provided by said analog signal supplying means.

* * * * *